US008132435B2

(12) United States Patent
Thomas et al.

(10) Patent No.: US 8,132,435 B2
(45) Date of Patent: Mar. 13, 2012

(54) LOCKING APPARATUS

(76) Inventors: Roy Thomas, Bolton (GB); John Tradewell, Yorkshire (GB)

( * ) Notice: Subject to any disclaimer, the term of this patent is extended or adjusted under 35 U.S.C. 154(b) by 82 days.

(21) Appl. No.: 12/663,409

(22) PCT Filed: Jun. 2, 2008

(86) PCT No.: PCT/GB2008/050398

§ 371 (c)(1),
(2), (4) Date: Dec. 7, 2009

(87) PCT Pub. No.: WO2008/149142

PCT Pub. Date: Dec. 11, 2008

(65) Prior Publication Data

US 2010/0175439 A1 Jul. 15, 2010

(30) Foreign Application Priority Data

Jun. 5, 2007 (GB) ..... 0710719.6

(51) Int. Cl.
*E05B 65/08* (2006.01)

(52) U.S. Cl. ..... 70/95; 70/100; 70/DIG. 11; 411/340; 411/21; 24/458; 292/251

(58) Field of Classification Search ..... 70/83, 95, 70/100, 116, 127, 128, DIG. 79, DIG. 11; 292/44, 49, 55, 63, 64, 65, 66, 67, 68, 69, 292/95, 121, 124, 194, 197, 212, 219, 224, 292/251, 301; 24/290, 291, 292, 453, 458, 24/525, 569, 613, 486; 411/21, 54, 340, 411/341, 343, 344, 345
See application file for complete search history.

(56) References Cited

U.S. PATENT DOCUMENTS

| | | | | | |
|---|---|---|---|---|---|
| 56,347 | A | * | 7/1866 | Beach | 292/49 |
| 744,985 | A | * | 11/1903 | Stuart | 411/340 |
| 972,853 | A | * | 10/1910 | Hambry et al. | 411/21 |
| 1,748,707 | A | * | 2/1930 | Ferris | 292/124 |
| 3,085,462 | A | * | 4/1963 | Myers | 411/348 |
| 3,600,912 | A | | 8/1971 | Foreman | |
| 4,062,089 | A | * | 12/1977 | Vinczer | 24/97 |
| 4,570,467 | A | | 2/1986 | Greco | |
| 4,714,391 | A | | 12/1987 | Bergner | |
| 4,764,065 | A | * | 8/1988 | Johnson | 411/21 |
| 6,193,261 | B1 | * | 2/2001 | Hahka | 24/453 |
| 6,385,876 | B1 | | 5/2002 | Mc Kenzie | |

(Continued)

FOREIGN PATENT DOCUMENTS

DE 1926922 U 11/1965

(Continued)

OTHER PUBLICATIONS

Search Report dated Mar. 28, 2007. Application No. GB0521463.0.

(Continued)

*Primary Examiner* — Suzanne Barrett
*Assistant Examiner* — David E Sosnowski
(74) *Attorney, Agent, or Firm* — Brooks Kushman P.C.

(57) ABSTRACT

A locking apparatus having a body, at least one arm and a tapered member; wherein relative movement between the arm and the tapered member extends the arm from the body. In use, the arm is arranged to press against a wall of a channel to hold the locking apparatus in place and prevent the opening of a roller shutter.

14 Claims, 4 Drawing Sheets

U.S. PATENT DOCUMENTS

| | | | | |
|---|---|---|---|---|
| 7,150,596 | B2 * | 12/2006 | Diaz et al. | 411/344 |
| 2003/0059271 | A1 | 3/2003 | Chou | |

FOREIGN PATENT DOCUMENTS

| | | | |
|---|---|---|---|
| DE | 29908169 | U1 | 9/1999 |
| EP | 1262626 | A2 | 12/2002 |
| GB | 553142 | | 5/1943 |
| GB | 2298894 | A | 9/1996 |
| GB | 2432876 | A | 6/2007 |

OTHER PUBLICATIONS

Search Report dated Mar. 17, 2008. Application No. GB0710719.6.

* cited by examiner

LOCKING APPARATUS

The present invention relates to locking apparatus.

Roller shutters are used to protect premises against malicious access. When a roller shutter is closed, a lock arrangement is used to prevent the shutter from being opened. However the lock arrangement used in typical roller shutters can generally be broken, for example using bolt cutters, thereby getting around the protection provided by the roller shutter.

To address this problem, additional locking means can be fitted to roller shutters after shutter installation. One such means requires a hole to be drilled into the guides of the shutter and the shutter itself, making first installation of such means difficult.

According to an aspect of the present invention, there is provided a locking apparatus arrangeable to secure a roller shutter, the apparatus comprising: a body, an arm and a tapered member; wherein relative movement between the arm and the tapered member extends the arm from the body.

Suitably, relative movement between the arm and the tapered member in an axial direction of the body extends the arm from the body in a radial direction.

Suitably, the locking apparatus further comprises biasing means arranged to bias the arm towards a position within the body. Suitably, the biasing means comprises a spring.

The tapered member may be of fixed axial position in the body, and the arm moves in the axial direction over the tapered member as the arm extends. That is, relative movement between the arm and the tapered member in an axial direction of the body is achieved by moving the arm in an axial direction of the body, over the tapered member, such that the arm moves simultaneously axially and radially.

Suitably, the apparatus further comprises a locking member. Suitably, rotation of the locking member causes relative movement of the arm and the tapered member. Suitably, rotation of the locking member in one direction causes relative movement of the arm and the tapered member to extend the arm from the body, whereas rotation of the locking member in an opposite direction allows the arm to retract back toward the body or to be retracted back toward the body.

Suitably, the locking member cooperates with a key such that rotation of the key rotates the locking member.

Suitably, the locking member comprises a threaded shaft.

Suitably, the tapered member is arranged on a threaded shaft. Suitably, rotation of the threaded shaft relative to the tapered member moves the tapered member along the threaded shaft in an axial direction of the body.

Suitably, the locking apparatus comprises an advancer coupled to the arm. Suitably, rotation of the threaded shaft relative to the advancer moves the advancer along the threaded shaft.

Suitably, the tapered member is cone-shaped.

Suitably, the body comprises a narrow portion and a wide portion, the narrow portion to be inserted into an aperture in a roller shutter guide channel.

Suitably, the body comprises a plurality of arms.

Suitably, the body comprises arm apertures, one for each arm and wherein each arm is arranged to extend through a corresponding arm aperture.

The present invention may be a locking apparatus for securing a roller shutter in position, the apparatus may comprise: a body in which at least one arm and a tapered member are located; wherein the at least one arm may be arranged to abut the tapered member such that relative movement between the arm and the tapered member may extend the arm from the body to, in use, engage the arm with part of the roller shutter to secure the roller shutter in position.

The relative movement between the at least one arm and the tapered member in an axial direction along the body may cause the arm to extend in a radial direction from the body; wherein, in use, the radial and axial movement may engage the at least one arm with part of the roller shutter.

The body may have a first and a second end; wherein the axial direction is from the first to the second end and the radial direction is perpendicular to the axial direction. Suitably, relative movement between the arm and the tapered member in an axial direction of the body extends the arm from the body in a radial direction.

In use, the relative movement between the arm and the tapered member may extend the arm from the body to engage the arm with a guide channel of a roller shutter and to hold the locking apparatus in position on the guide channel. The locking apparatus so positioned may provide an obstruction in the guide channel to prevent a roller shutter from being opened.

The body may comprise a narrow portion and a wide portion; wherein in use, the narrow portion may be inserted into an aperture in a wall of a guide channel. The arm may be located in the narrow portion.

The body may comprise a narrow portion extending from a wide portion, the narrow portion may comprise the at least one arm; wherein, in use, the narrow portion may be arranged through an aperture in a wall of the guide channel to protrude from an internal surface of the wall to provide an obstruction to the movement of a slat of the roller shutter; and wherein, in use, the wide portion may be positioned to abut an external surface of the wall such that the at least one arm may be engaged with the internal surface to hold the locking apparatus in position. The locking apparatus may thus be tightly held in position.

The body may comprise a first and a second end; and wherein relative movement between the arm and the tapered member in an axial direction from the first to the second end may extend the arm from the body in a radial direction.

The relative movement between the arm and the tapered member in an axial direction of the body may be achieved by moving the arm in an axial direction of the body over the tapered member, such that the arm may move simultaneously axially and radially.

The apparatus further comprises a locking member; wherein rotation of the locking member may cause the relative movement between the arm and the tapered member.

Rotation of the locking member may cause the relative movement between the arm and the tapered member in the axial and radial directions.

Rotation of the locking member in one direction may cause the arm to extend the arm from the body, whereas rotation of the locking member in an opposite direction may allow the arm to retract back toward the body.

Rotation of the locking member may cause the relative movement of the arm and the tapered member. Continuous rotation of the locking member may cause continuous relative movement of the arm and the tapered member.

The locking member may comprise a lock and a key that cooperates with the lock, such that rotation of the key rotates the lock.

The locking member may comprise a shaft, the shaft may comprise a threaded region; wherein the at least one arm and the tapered member may be arranged on the shaft such that rotation of the shaft may cause the relative movement between the arm and the tapered member; and wherein rotation of the lock may cause the rotation of shaft.

The locking apparatus may comprise an advancer coupled to the arm; wherein the advancer may be arranged on the shaft such that rotation of the shaft may cause the advancer to move along the threaded region.

The locking apparatus may further comprise biasing means arranged to bias the at least one arm towards a position within the body.

The biasing means may be a spring.

The tapered member may be of a fixed axial position in the body, and the movement of the at least one arm in the axial direction may move the arm over the tapered member to extend the at least one arm in the radial direction.

The tapered member may comprise a cone-shaped region. The tapered member may comprise cone-shaped region and an annular region connected to the cone-shaped region. The tapered member may be arranged in the locking apparatus so that, in use, the cone shaped region extends the arms from the body to be in an extended position and the annular region maintains the arms in the extended position.

The apparatus may comprise a plurality of arms located within the body.

The body may comprise arm apertures, one for each arm and wherein each arm may be arranged to extend through a corresponding arm aperture.

According to the present invention there is provided apparatus as set forth in the appended claims. Other features of the invention will be apparent from the dependent claims, and the description which follows.

For a better understanding of the invention, and to show how embodiments of the same may be carried into effect, reference will now be made, by way of example, to the accompanying diagrammatic drawings in which.

Figure 1:
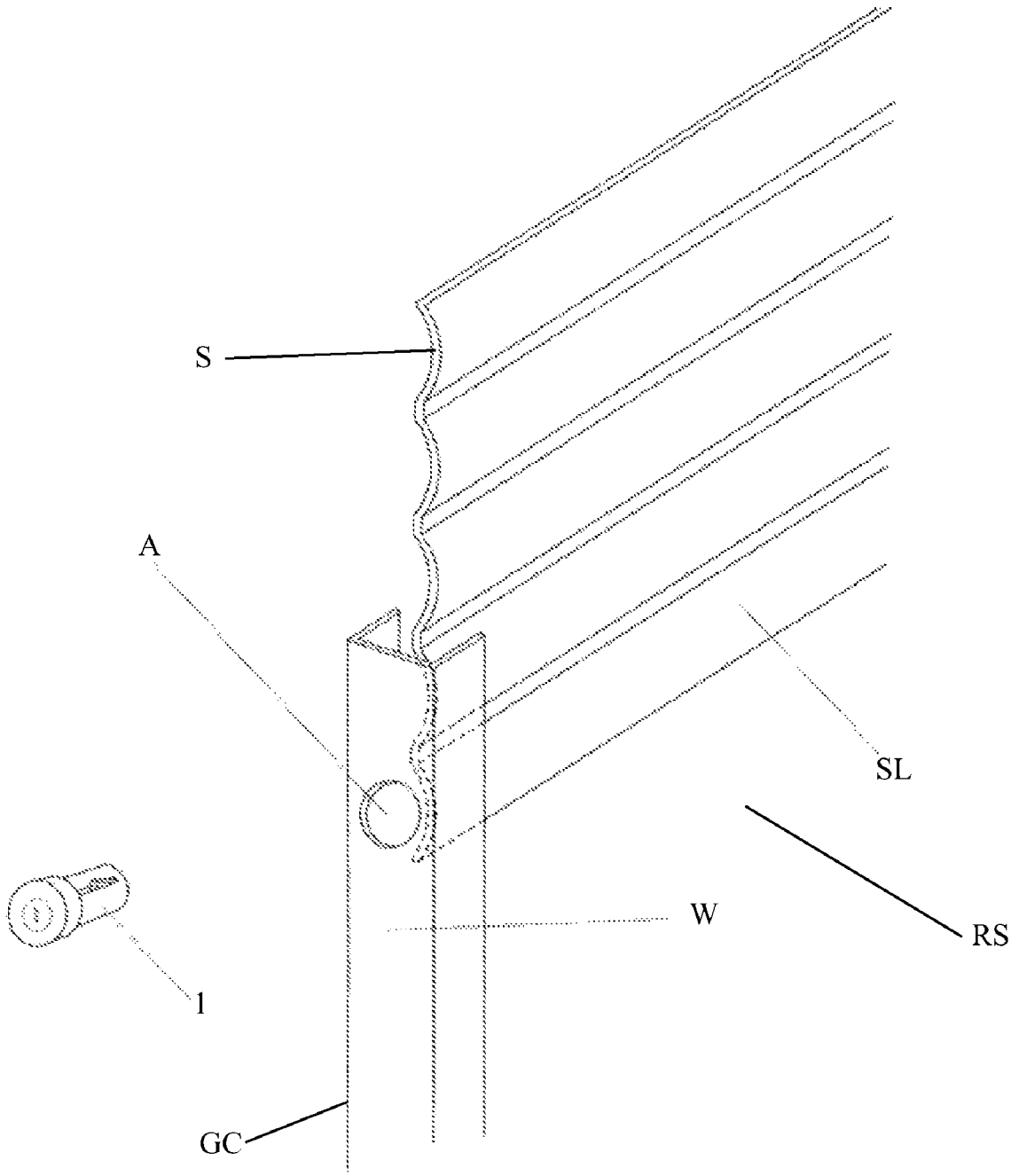
FIG. 1 shows a perspective view of a locking apparatus of a first embodiment of the present invention being arranged relative to an aperture in a guide channel of a roller shutter.

FIG. 1 shows part of a roller shutter RS which is securable using the locking apparatus 1. The roller shutter comprises a guide channel GC to guide a shutter S between open and closed positions. The shutter S comprises a plurality of slats SL, which allow the shutter to be rolled up to open the shutter and rolled down to close the shutter. The shutter S is rolled up and rolled down from a shutter container (not shown) located at the top of the area covered by the roller shutter RS.

As is shown by FIG. 1, an aperture A is formed in a wall W of the guide channel GC for example, by drilling. The aperture A is provided to allow the locking apparatus to be inserted into the guide channel GC and to be tightly fixed in position on the wall W. In this way the locking apparatus 1 protrudes from an internal surface of the wall to provide an obstruction to the movement of the shutter S. The obstruction is provided by the locking apparatus 1 becoming engaged with one of the plurality of slats, if an attempt is made to open the shutter S with the locking apparatus 1 in position in the guide channel GC.

The locking apparatus 1 does not have to be aligned with any particular slat of the plurality of slats SL. In this way, the locking apparatus 1 is used to secure the shutter S at a range of positions between a fully open position and a fully closed position.

FIGS. 1-6 show example embodiments of a locking apparatus 1, 2, 3 used to secure the roller shutter RS. The locking apparatus 1, 2, 3 comprise a body 10, first and second locking arms 20 and a lock member 50. In use the locking apparatus 1, 2, 3 is positioned through an aperture A and the locking arms 20 are used to press the body 10 against the wall W to firmly hold the locking apparatus 1, 2, 3 in place in the guide channel GC. In this way, the locking apparatus 1, 2, 3 reduces the likelihood of a roller shutter being opened maliciously as it is difficult to insert a tool between the body 10 and the guide channel GC in order to try to pry out the locking apparatus 1, 2, 3.

When it is desired to lock the roller shutter RS, the shutter S is held in position and the locking apparatus 1, 2, 3 is inserted through the aperture A. The locking arms 20 are then moved to press against the guide channel GC in the region R shown in the drawings. The locking arms 20 are moved by the lock member 50 until they are pressed against the guide channel to hold the lock assembly 1, 2, 3 firmly in position.

The locking apparatus 1, 2, 3 is used to provide an obstruction to the movement of the shutter. This obstruction is provided by arranging at least part of the locking apparatus 1, 2, 3 to protrude into an area of the guide channel through which the shutter would pass when it is being opened. The presence of the locking apparatus in that area inhibits movement of the shutter along the guide channel. The locking apparatus 1, 2, 3 in the guide channel blocks movement of the roller shutter in the guide channel, either by filling a naturally occurring void between slats in the shutter, or by blocking any other suitable body, such as part of the slat, which would normally pass along the guide channel. In this way, the locking apparatus 1, 2, 3 prevents the shutter from being opened.

The locking apparatus 1, 2, 3 can be located in an aperture at any position along the guide channel. Arranging the locking apparatus 1, 2, 3 in this way negates the need for a user to align a locking apparatus 1, 2, 3 with an aperture in the shutter itself to secure the lock in place. The locking apparatus 1, 2, 3 described allows the user to achieve a secure coupling between the locking apparatus 1, 2, 3 and the guide channel while accommodating variations in guide channel thickness, as will now be described.

The locking apparatus 1 of the first embodiment comprises all the internal features shown for the locking apparatus 2 of the second embodiment. These internal features and their operation will now be described with reference to FIGS. 3 and 4.

Figure 3:
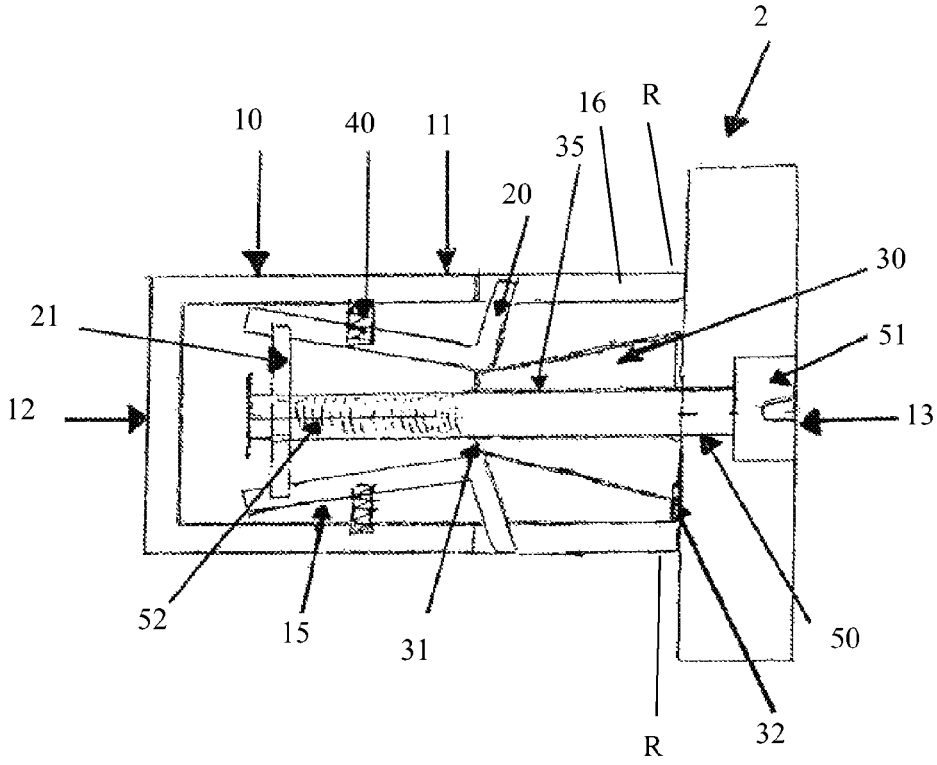
FIG. 3 shows a cross-sectional side view of a locking apparatus of a second embodiment of the present invention with arms within a body.
Figure 4:
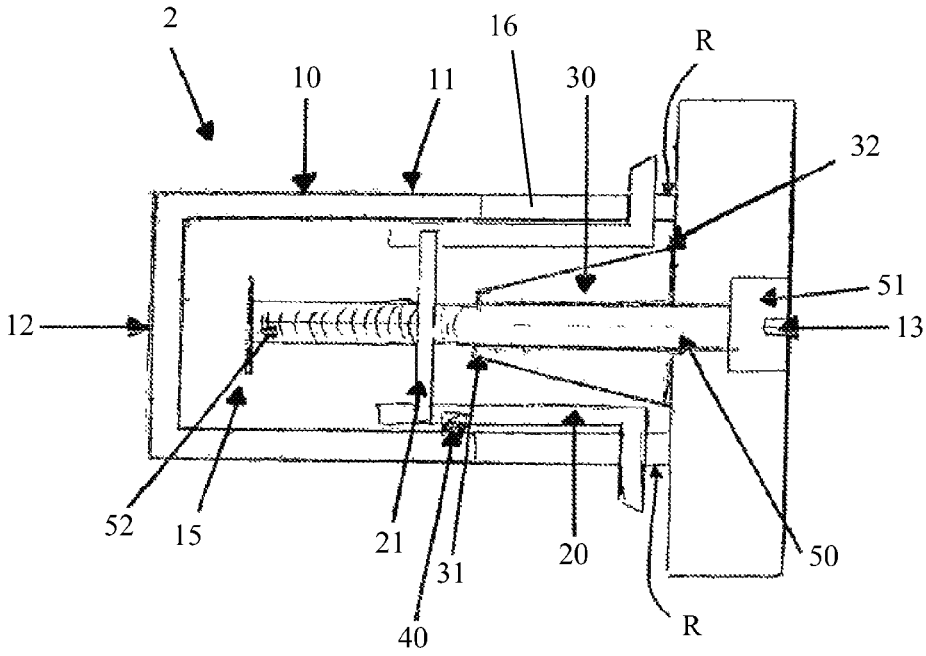
FIG. 4 shows a cross-sectional side view of the second embodiment with arms extending from the body.

FIG. 3 shows the locking apparatus 2 having a tapered member 30. The tapered member 30 abuts the locking arms 20. The tapered member 30 is arranged to engage with locking arms 20 to move the locking arms 20 from within the body 10. As shown in FIG. 3, the locking arms 20 are located in a retracted position within the body 10, i.e., each arm 20 is maintained substantially flush with or beneath an external surface 11 of the body 10. In contrast, FIG. 4 shows the locking arms 20 extending from beyond the external surface 11 of the body 10.

The tapered member 30 is arranged to taper in an axial direction of the body from a widest point 32 located at the second end 13 of the body 10 towards a narrowest point 31 at the first end 12 of the body 10. The tapered member 30 is cone-shaped with a channel 35 running from one end to the other.

Figure 2:
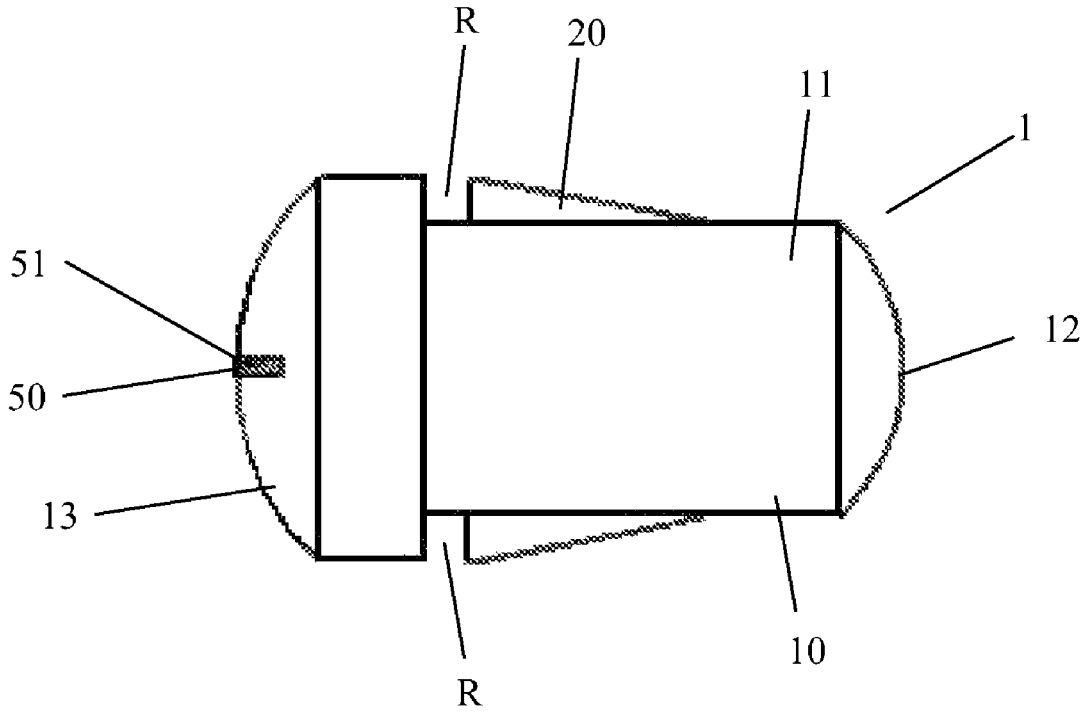
FIG. 2 shows a side view of the first embodiment.

Relative movement between the locking arms 20 and the tapered member 30 moves the locking arms 20 radially outward from within the body 10 to a position extending from the body 10. Also, as can be seen in FIGS. 1 and 2, the locking arms 20 are also movable in an axial direction of the body 10 from a first end 12 toward a second end 13 of the body 10.

The body 10 comprises a cavity 15. The cavity 15 provides space allowing the locking arms 20, the tapered member 30 and a spring 40 to be contained within the body 10.

The body further comprises a plurality of arm apertures 16. Each arm aperture 16 is located to correspond to the position of a locking arm 20. Each arm aperture 16 allows a locking arm 20 to extend there-through externally from the body 10 and be moved from the first end 12 of the body 10 toward the second end 13 of the body 10.

The spring 40 is an example of biasing means employed to bias the locking arms 20 toward a position retracted within the body. The biasing means 40 may comprise a circlip, circular spring, a coil spring or other suitable means.

FIG. 3 shows the locking arms 20 extending from beyond the external surface 11 of the body 10. The mechanism by which relative movement between the locking arms 20 and the tapered member 30 is controlled will now be described.

The locking apparatus 2 further comprises an advancer 21 coupling the locking arms 20 to a locking member 50. The advancer 21 is the mechanism used to move the arms relative to the tapered member 30.

The locking arms 20 are arranged with one end pivotally coupled to the advancer 21 and the other end free to extend from the body. In use, the arms are extended to engage with the wall of a roller shutter guide channel. The locking arms 20 are arranged to contact the tapered member 30 at the free end, i.e. the end of the arms opposed to the pivotally coupled end.

The lock member 50 of the locking apparatus 2 comprises a lock 51 and a shaft 52 with a threaded region and is arranged to extend from the second end of the locking apparatus 2 towards the first end of the locking apparatus. The lock 51 is configured to receive a key (not shown). In use, the key is inserted into the lock 51, enabling the threaded shaft 52 to be rotated. The locking member 50 engages with the advancer 21. Rotation of the threaded shaft 52 draws the advancer 21 along the threaded shaft 52. With this motion the locking arms 20 impinge on and move over the tapered member 30 causing the locking arms 20 to extend from within the body 10.

In use, the locking assembly 2 is inserted into an aperture, such as in a roller shutter guide channel. A key (not shown) is inserted into the lock 51 and rotated. Rotating the key causes the threaded shaft 52 to rotate. Rotation of the threaded shaft 52 causes the advancer 21 to move along the shaft 52.

If the key is rotated clockwise, for example, the advancer 21 moves from the first end 12 of the body 10 towards the second end 13 of the body 10. The movement of the advancer 21 causes the locking arms 20 to move from the narrowest point 31 of the tapered member 30 toward the widest point 32 of the tapered member 30. Continued rotation of the key in this direction causes the locking arms 20 to move from a position retracted within the body 10 to an extend position outside the body 10, and at the same time to be advanced towards and engaged with the material, such as the side wall of the guide channel, surrounding the aperture in which the body 10 is located. By selecting the amount of key rotation, the amount of pressure between the locking arms 20 and the material surrounding the aperture in which the body 10 is located can be controlled, taking into account the thickness of that material. In this way, the arms become pressed flush against the material surrounding the aperture in which the body 10 is located.

To retract the locking arms the key is rotated counter-clockwise, for example, and the advancer 21 moves away from the second end 13 of the body 10 and towards the first end 12 of the body 10. The movement of the advancer 21 combined with the biasing effect of the spring 40 causes the locking arms 20 to increasingly move from the widest point 32 of the tapered member 30 to the narrowest point 31 of the tapered member 30. Continued rotation in this sense causes the locking arms 20 to be moved from the extended position to a retracted position, so that the locking apparatus 2 can be removed from the aperture.

In both cases the key is removed from the locking member 50 after rotation is completed, preventing further rotation of the locking member 50.

The body 10 comprises a narrow region at the first end 12 of the body 10 and a wide region the second end 13 of the body 10. The narrow region is of smaller width than the wide region such that the narrow region fits through an aperture in the channel. The arms 20 are located in the narrow region. The wide region prevents the locking apparatus 1 from passing through the aperture when the locking arms 20 press against the wall of a roller shutter channel, for example.

In preferred embodiments, the narrow and wide regions are cylindrical. The narrow region may suitably have a diameter in the range 1 cm to 2.5 cm. The wide region may suitably have a diameter in the range of 1.5 cm to 3.5 cm. The length of the body 10 from the first to the second end may suitably be in the range of 2 cm to 10 cm.

In use, the narrow region is arranged through an aperture in a wall of the guide channel. The arms located in the narrow region are then engaged with an internal surface of the wall. Engaging the arms with the internal surface causes the wide portion to be pressed against an external surface of the wall. The effect of engaging the arms and the wide portion with the internal and external surfaces cause the locking apparatus to be held, tightly, in position to provide an obstruction in the form of a protrusion that prevents the shutter being opened, maliciously.

Figure 5:
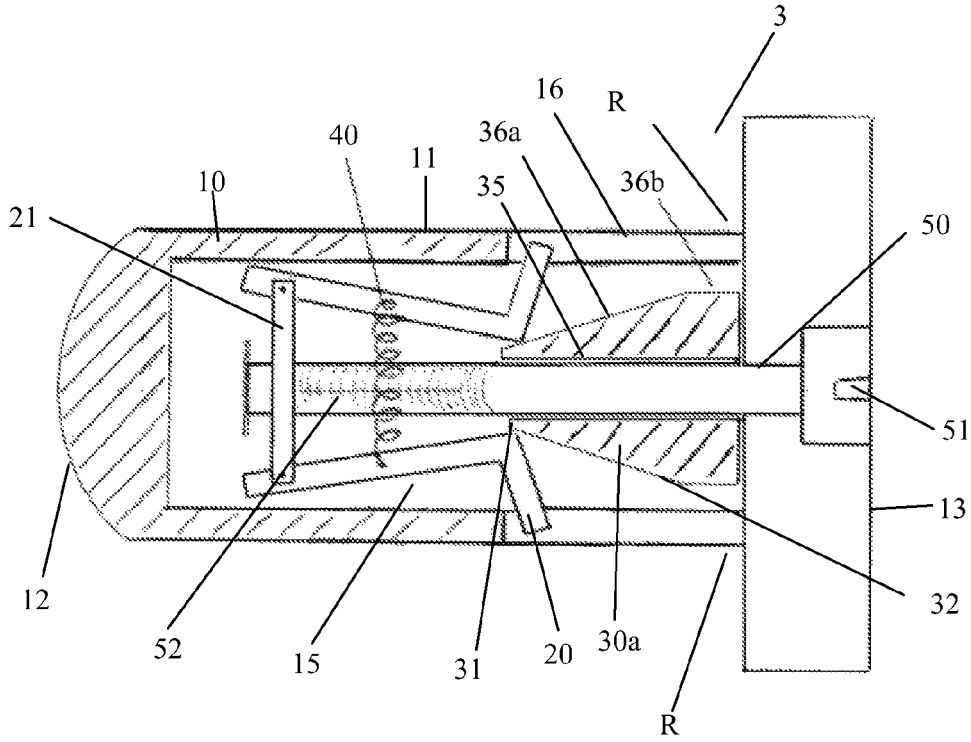
FIG. 5 shows a cross-sectional side view of a locking apparatus of a third embodiment of the present invention with arms within a body.
Figure 6:
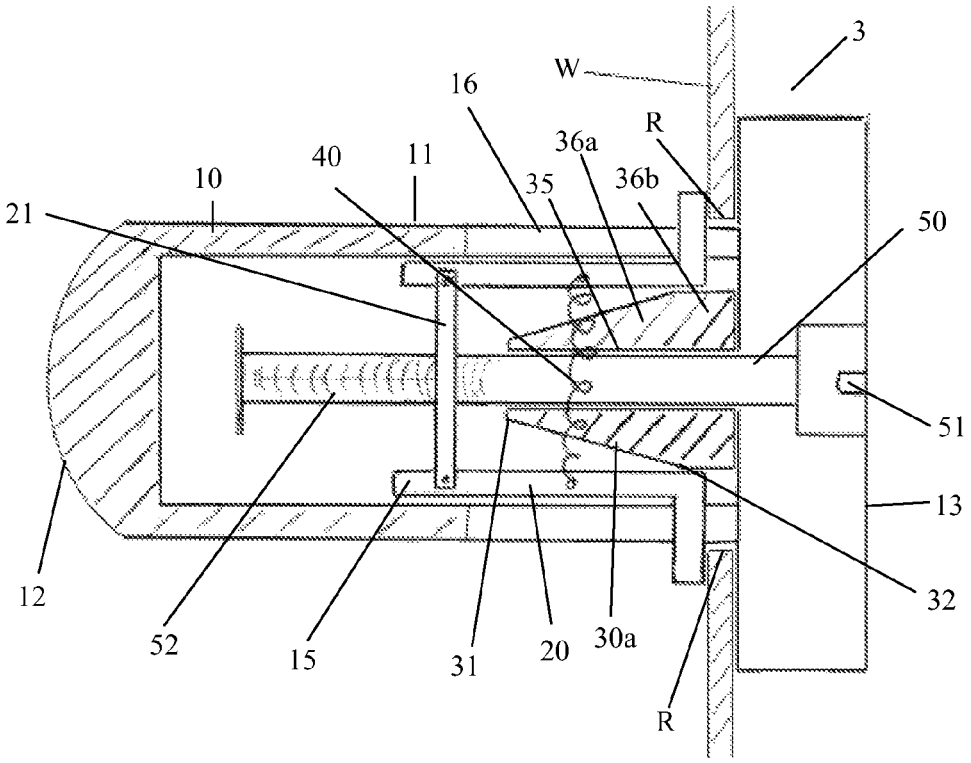
FIG. 6 shows a cross-sectional side view of the third embodiment with arms extending from the body.

FIGS. 5 and 6 show a third embodiment of the locking apparatus 3. The third embodiment comprises features in common with the first and second embodiments and the features common to the embodiments use the same reference numerals.

The locking apparatus 3 comprises a tapered member 30*a* having a cone shaped region 36*a* and an annular region 36*b*. The tapered member 30*a* is shaped so that the widest part of the cone shape is connected to the annular region. In this way, the slope of the tapered member serves to extend the arms from the body 10, in use, and the annular region 36*b* maintains the arms in the extended position as they are engaged with the wall W.

The locking apparatus 3 also comprises an alternative arrangement for the biasing means 40. The biasing means 40 is a circular spring that extends around the internal cavity 15 of the body 10 and is attached to each of the arms 20 to bias them towards a position in which are retracted within the body.

As discussed, once an aperture is provided in a wall of a roller shutter guide channel, the locking apparatus 1, 2, 3 can be simply installed to provide an additional level of security by locking the shutter in place.

Although a few preferred embodiments have been shown and described, it will be appreciated by those skilled in the art that various changes and modifications might be made without departing from the scope of the invention, as defined in the appended claims.

Attention is directed to all papers and documents which are filed concurrently with or previous to this specification in connection with this application and which are open to public inspection with this specification, and the contents of all such papers and documents are incorporated herein by reference.

All of the features disclosed in this specification (including any accompanying claims, abstract and drawings), and/or all of the steps of any method or process so disclosed, may be combined in any combination, except combinations where at least some of such features and/or steps are mutually exclusive.

Each feature disclosed in this specification (including any accompanying claims, abstract and drawings) may be replaced by alternative features serving the same, equivalent or similar purpose, unless expressly stated otherwise. Thus, unless expressly stated otherwise, each feature disclosed is one example only of a generic series of equivalent or similar features.

The invention is not restricted to the details of the foregoing embodiment(s). The invention extends to any novel one, or any novel combination, of the features disclosed in this specification (including any accompanying claims, abstract and drawings), or to any novel one, or any novel combination, of the steps of any method or process so disclosed.

The invention claimed is:

1. A locking apparatus for securing a roller shutter within a guide channel having an aperture formed therein, the locking apparatus comprising:

a hollow tubular body having an enlarged end and an elongated section sized to fit within the aperture, the tubular body further including a tapered member fixed therein and a radial opening;

a threaded locking member coaxial with the tubular body having a head portion and an elongate threaded shaft extending past the tapered member;

an advancer threadedly connected to the threaded shaft such that the advancer is enabled to move axially along the shaft as the shaft rotates; and a arm having a pivot end connected to the advancer and a free end oriented between the advancer and the enlarged end, so that when the advancer is spaced away from the enlarged end the arm is retained within the tubular body, and when the advancer moves towards the enlarged end the arm cooperates with the tapered member to extend radially outward through the radial opening.

2. The locking apparatus of claim 1, wherein the radial and axial movement engages the arm with part of the roller shutter.

3. The locking apparatus of claim 1, wherein the elongated section is arranged through the aperture in a wall of the guide channel to protrude from an internal surface of the wall to provide an obstruction to the movement of a slat of the roller shutter; and wherein, in use, the enlarged end is positioned to abut an external surface of the wall such that the arm is engaged with the internal surface to hold the locking apparatus in position.

4. The locking apparatus according to claim 1, wherein the body comprises a first and a second end; and wherein relative movement between the arm and the tapered member in an axial direction from the first to the second end extends the arm from the body in a radial direction.

5. The locking apparatus according to claim 1, wherein relative movement between the arm and the tapered member in an axial direction of the body is achieved by moving the arm in an axial direction of the body over the tapered member, such that the arm moves simultaneously axially and radially.

6. The locking apparatus according to claim 1, wherein rotation of the locking member in one direction causes the arm to extend from the body, whereas rotation of the locking member in an opposite direction allows the arm to retract back toward the body.

7. The locking apparatus according to claim 1, wherein the locking member comprises a lock and a key that cooperates with the lock, such that rotation of the key rotates the lock.

8. The locking apparatus according to claim 7, wherein the arm and the tapered member are arranged on the shaft such that rotation of the shaft causes the relative movement between the arm and the tapered member; and wherein rotation of the lock causes the rotation of the shaft.

9. The locking apparatus according to claim 1, wherein the tapered member is of a fixed axial position in the body, and the movement of the arm axially moves the arm over the tapered member to extend the arm radially.

10. The locking apparatus according to claim 1, wherein the tapered member comprises a cone-shaped region.

11. The locking apparatus according to claim 1, further comprising a plurality of arms located within the body.

12. The locking apparatus according to claim 11, wherein the body comprises arm apertures, one for each arm and wherein each arm is arranged to extend through a corresponding arm aperture.

13. The locking apparatus according to claim 1, wherein a spring is fixed to the arm to bias the arm towards the threaded locking member.

14. The locking apparatus according to claim 1, wherein rotation of the shaft and axial movement of the advancer secures the roller shutter to the guide channel.

* * * * *

UNITED STATES PATENT AND TRADEMARK OFFICE

CERTIFICATE OF CORRECTION

PATENT NO. : 8,132,435 B2
APPLICATION NO. : 12/663409
DATED : March 13, 2012
INVENTOR(S) : Roy Thomas It is certified that error appears in the above-identified patent and that said Letters Patent is hereby corrected as shown below:

Column 7, Line 36, Claim 1:

Delete “a arm having a pivot” and insert -- an arm having a pivot --.

Signed and Sealed this
Eighth Day of May, 2012

David J. Kappos

David J. Kappos
*Director of the United States Patent and Trademark Office*